US005921647A

United States Patent [19]

Schneider et al.

[11] Patent Number: 5,921,647

[45] Date of Patent: Jul. 13, 1999

[54] FURNITURE

[75] Inventors: Franz Alois Schneider, Roodeport; Gerd Rainer Fichtner, Gauteng, both of South Africa

[73] Assignee: Vavarian Design Concept CC, Wadeville, South Africa

[21] Appl. No.: 08/903,542

[22] Filed: Jul. 30, 1997

[30] Foreign Application Priority Data

Aug. 8, 1996 [ZA] South Africa ..... 96/6743

[51] Int. Cl.[6] ..... A47B 47/00

[52] U.S. Cl. ..... 312/265.3; 211/187; 312/265.4; 312/108

[58] Field of Search ..... 312/257.1, 265.1, 312/265.2, 265.3, 265.4, 263, 107, 108, 111, 351; 211/208, 187; 248/220.43, 243

[56] References Cited

U.S. PATENT DOCUMENTS

| | | | |
|---|---|---|---|
| 3,330,229 | 7/1967 | Ferdinand et al. | 211/187 X |
| 3,353,888 | 11/1967 | Pritelli, Jr. | 312/111 X |
| 3,884,002 | 5/1975 | Logie | 312/263 X |
| 4,447,096 | 5/1984 | Peri et al. . | |
| 4,768,845 | 9/1988 | Yeh | 312/257.1 |
| 4,854,654 | 8/1989 | Korpela | 312/265.1 |
| 5,380,083 | 1/1995 | Jones et al. . | |

FOREIGN PATENT DOCUMENTS

| | | | |
|---|---|---|---|
| 857195 | 12/1970 | Canada | 312/111 |
| 2501310 | 9/1982 | France | 312/107 |
| 2635256 | 2/1990 | France | 312/257.1 |
| 2 672 783 A1 | 8/1992 | France . | |
| 2701969 | 7/1978 | Germany | 312/265.4 |
| 3607803 A1 | 9/1987 | Germany . | |
| 2 129 903 | 5/1984 | United Kingdom . | |

OTHER PUBLICATIONS

Exhibit A: Flototo Moedel brochure, 1995/96.

*Primary Examiner*—Peter M. Cuomo
*Assistant Examiner*—Janet M. Wilkens
*Attorney, Agent, or Firm*—Merchant, Gould, Smith, Edell, Welter & Schmidt, P.A.

[57] ABSTRACT

A new concept of assembly furniture comprises frame components and panels which fit in grooves in the frame components together with fixing members for fixing frame components to each other at their ends, for example, parallelepedic furniture units. The frame components furthermore have formations in them, for example, a set of holes of standardized pitch into which elongate members which have matching formations at their ends can fit when the frame components are assembled. These elongate members with formations at their ends allow for the mounting of hinges, drawer runners and shelf supports and the like without the necessity for drilling, screwing or any other fastening approach. The key feature of the assembly furniture is that it is capable of being disassembled and reassembled into different kinds of furniture by the owner thereof. For example, in a child's bedroom as the child grows up the style in aesthetic respects and functional aspects of the furniture can be changed using the original components purchased.

5 Claims, 7 Drawing Sheets

FURNITURE

BACKGROUND OF THE INVENTION

This invention lies in the field of furniture in a broad sense being applicable in domestic or personal applications, in office or business applications, hotels and in general any other applications.

For many years already "do-it-yourself" furniture has been available the concept being the manufacture and supply of components for furniture which are assembled by the purchaser after purchase. This allows some reduction of the price of the furniture since the manufacturer and supplier does not have to provide the assembly thereof and some advantage in storage and transport of the furniture in a collapsed state since it is usually more compact in that stage than when assembled.

All of such furniture is, however, akin to conventional furniture in being purpose made, that is it is made to provide one article of furniture of a particular kind. Thus having purchased even a "do-it-yourself" or collapsible item of furniture one can only make that particular item by assembling the components or disassemble them and later reassemble them into the component; one cannot make a different article of furniture from the components.

The inventors in the present case have perceived changes in the market for furniture, for example, the pace of change in circumstances affecting businesses is ever increasing; with concomitant increases in the standards of living and of facilities and accommodation in business, cost levels are increasing requiring greater economy in the floor area available for furniture and in the utilisation of furniture. In addition, due to the heightened pace of change which is being referred to, pressure is added to more frequently change the furnishing of premises. These tendencies in business and commercial circumstances find their counterpart even in domestic situations where increasing standards of living are sought with the implication of increasing costs of living and an expectation on top of this of change and improvement in furnishings at a pace not expected in earlier times.

Young families, which have young children tend to need to cater for a small budget and to provide for changing and development of the furniture as the children grow, providing new functional and aesthetic characteristics. The problem existing in the art is that common "do-it-yourself" or knock-down furniture cannot cater for such needs.

SUMMARY OF THE INVENTION

The solution of this problem in accordance with this invention is to provide components for furniture which comprise a plurality of frame components of elongate form and at least one panel, the frame components having longitudinally extending grooves of a standard width and position in the frame components, the grooves capable of receiving edge(s) of the panel(s), the frame components having fixing means near their ends adapted for fixing the frame components to each other, the frame components further comprising formations for receiving the fixing of components selected from hinges, drawer runners, shelf supports and like components.

The furniture according to the invention thus has the advantages of knock-down furniture but it is in fact more than this since the frame components can be assembled in assemblies of more than one proportion and dimension, to allow for the possibility of the same components being used for different or upgraded items of furniture.

For example, a very simple change would be merely for the panels to be turned so that the side initially facing inwardly on a piece of furniture would then face outwardly. Since the panels can be made with different finishes on their two surfaces this can produce a considerable change to the style or image of the furniture. For example in domestic usage as a child grows older one surface of the panels containing colourful illustrations of cartoon characters can at a suitable age be reversed to show a more mature patterning or ornamentation. In the corporate application the panels can be selected and be changeable to present a desirable corporate image from time to time.

The furniture components in accordance with the invention are thus frame based or may be said to be skeletally base, although when the panels are incorporated within the frame they tend to rigidify the frame further. No additional means of securing the panels is provided, the arrangement being such that the edges of the panels are entirely enclosed within grooves of surrounding frame components. Since the standardised groove width is selected this is made suitable to accept any selection of panel thus not only, for example, opaque panels such as those which would be available in plywood, in hard board such as "Masonite" (trademark) in reconstituted wood chips "chip board" (trademark) but also in sheets of glass or coloured or translucent or transparent plastic, and the like.

In preferred embodiments the longitudinal frame components are of square or rectangular cross sectional shape and the grooves are located in the centre of at least one side of the frame components. For example, the frame components may be of wood.

The location of the grooves in the centre is an important preferred feature as this confers greater universality to the usage of the components since the components will be mirror reversible providing greater flexibility and adaptability of usage.

It is also an important feature of the invention that the width of the grooves is standardised; if a panel is to be fitted which is narrower than the groove a groove insert can be provided to reduce its effective width. This has the advantage that should a change later be made to thicker panels the grooves are still entirely suitable simply by removing the inserts.

An important preferred feature is that the edges of the panel have a peripheral groove running all around the panel; this makes the edges of the panel compressible, i.e. the edge thickness of the panel can be compressed. By giving the grooves in the frame components a width which is within a tolerance range less than the panel thickness the groove in the panel edges then allows the panel edges to be pressed into the groove of the frame components with a snug fit, even when the panel thickness varies. Thus panels of differing thicknesses can all be fitted into the grooves of the frame components snugly without rattling or being too tight to go in.

A preferred feature of the invention of considerable importance is that the components are provided in combination with elongate elements having end formations at or attachable at their ends, having lengths including the formations matching the lengths of frame components, the formations at the ends of the elongate elements adapted to engage into the formations in frame components which are fixed orthogonally to the frame components of equal length to the elongate elements.

Preferred frame components for receiving end formations carrying components selected from one or more of hinges, drawer runners, shelf supports and/or the like have a plurality of holes provided along the length of the frame components at a standardised pitch.

The advantageous results of this arrangement are that components such as hinges, drawer runners and shelf supports are in the first place not supplied as part of or attached to the frame components, nor do they have to be attached to the frame components, for example, by drilling and screwing or any analogous manner, they automatically become mounted in the frame components when these are brought together with the fixing means at the ends of the frame components being actuated to fix the frame components together. As they are brought together the end formations at the ends of the elongate elements engage with matching formations in the frame components, for example, pins fitting into the holes of standardised pitch. The result of this is that the frame components are not damaged or defaced by the attachments of hinges, drawer runners, shelf supports or the like and once again the components of furniture can be disassembled and reutilised in a different way without any residual detraction from them.

Preferably the elongate elements are so adapted that they can have attached to them and then carry one or more selected from hinges, drawer runners, shelf support and the like. The drawer runners and the shelf supports can themselves constitute the elongate elements; the hinges can be fixed to the formation sat the ends of the elongate elements.

Thus the hinges, drawer runners, shelf supports, etc. can be selected as required and then fitted to the ends of the elongate elements.

A further preferred feature of the invention is that it provides fixing means adapted to unitarily fix together not only frame components of one unit of furniture but also simultaneously adjacent units of furniture.

This allows the stable stacking of several units, for example, one above another without a danger of coming apart or of one slipping off another.

An option in accordance with the invention is to provide some of the frame members preassembled in a rigid and durable way so as to provide sub-assemblies for use in manufacturing furniture. This can have advantages in certain applications.

The furniture which can be made thus can be based on a modular system, for example, base units of a standardised dimension which can be stacked adjacent each other and on top of each other as required to make up a total unit. Modified units of different widths, height and depth, however, can also be provided.

The principle of assembly of the furniture is different to common knock-down furniture also in the respect that all the required fittings for assembling including the drawer runners, hinges, shelf supports and the like are attached to the frame components and not linked or connected to any of the panels whether on the side, top or bottom. This allows the interchanging possibility of the panels for aesthetic reasons without interfering or having to alter the technical or functional aspects of the furniture unit.

Further optional material for the panels would be wire mesh, fabric and the like. Apart from manufacturing the frame components in wood these could also be supplied in steel or plastics, for example.

The invention then also permits the production of personalised furniture. For example, the panels could include paper drawings made by a child of the family, or for corporate applications the corporate logo could be provided onto the panels. This is made possible because the panels can, if desired, be manufactured in a thermo-processing process which uses fabric or paper for the finished surface.

The invention will be more fully described by way of examples with reference to the accompanying drawings in which:

BRIEF DESCRIPTION OF THE DRAWINGS

FIG. 8 is a side elevation of a unit having runners for drawers with a pencil tray.

DESCRIPTION OF THE PREFERRED EMBODIMENTS

Figure 1:
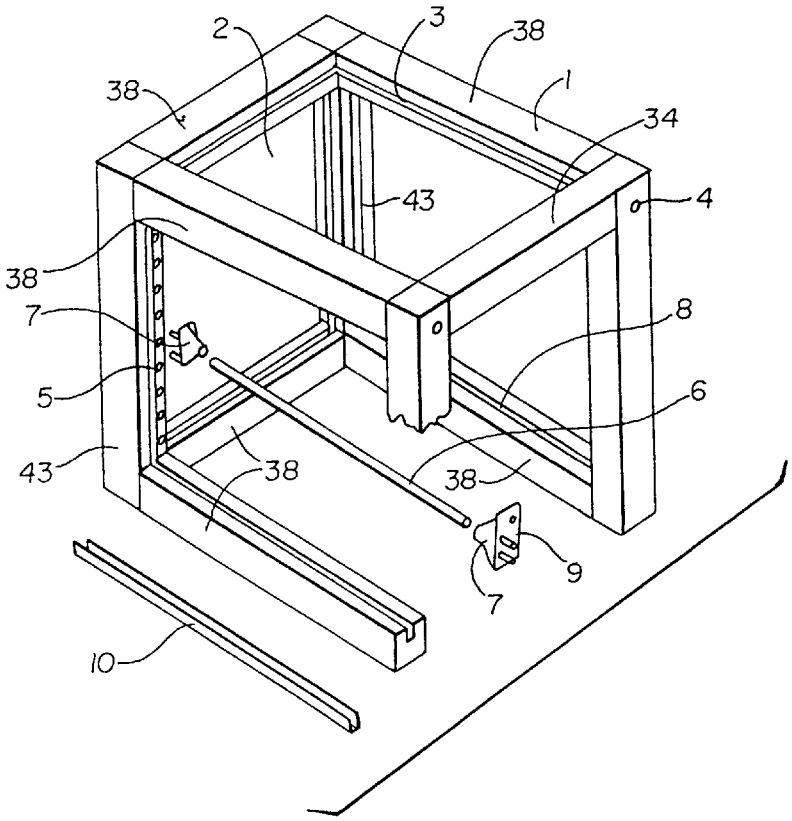
FIG. 1 is a perspective view of an assembly frame and other components according to the invention.

As shown in FIG. 1 components for furniture in accordance with the preferred embodiment of the invention comprise twelve frame components e.g. 1 into which at least one panel (not shown) is inserted into the longitudinally extending grooves 8. The grooves are of a standard width and as a result groove inserts 10 are provided for panels of thinner dimension. All of the grooves in the frame components are located in the centre of a side of the component; some components have grooves on two sides, others only on one side. The frame components have fixing means 4 in the form of bolts which will be explained more fully below near the ends of the frame component. These bolts fix the frame components to each other and the frame components further comprise formations in the form of a set of equally spaced holes 5. The holes 5 are for resealing the fixing of components selected from hinges, drawer runners, shelf supports and like components which also will be described below. These components are supported by means of elongate members 6 to the opposite ends of which are fixed formations 7 which have pins to fit into the holes 5. Because the lengths of elongate members with the attached formations 7 matches the lengths of the frame components, when all twelve frame components are assembled the elongate members 6 and formation 7 become locked in position, a position which is selected according to the level required for a drawer, a shelf, a hinge or other components. At the same time, if the frame components are disassembled by releasing the fixing means in the forms of the bolts 4 then the elongate members and the formations can be reassembled into new positions. This allows the unit of furniture made with these components to be changed at a later date when it is desired to do so. Not only that, but the frame components could be reassembled with different frame components, for example of different lengths. These possibilities will be described further below.

Figure 2:
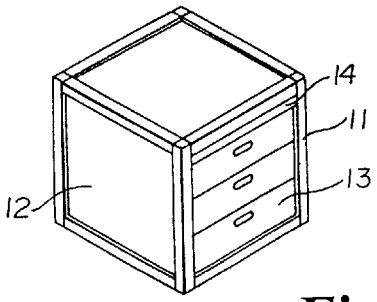
FIG. 2 is an isometric view of a three-drawer unit in accordance with the invention.

For example, as shown in FIG. 2 twelve components 11 are assembled into a cubed outline, for example, 600 mm in dimension, panels 12 are fitted in five of the six sides of the cube and on the front side three drawers 13 are provided with a pencil tray 14 above.

Figure 3:
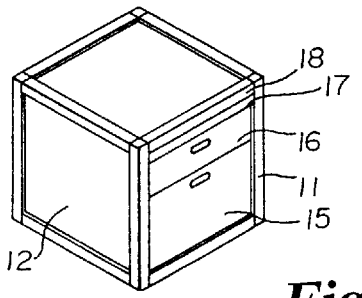
FIG. 3 is a similar view of a two-drawer unit with pencil tray.

As shown in FIG. 3 the same frame components 11 with panels 12 could be assembled with a different arrangement of drawers being a deep drawer 15, a shallow drawer 16 and two pencil trays 17 and 18. This would be an alternative when first purchasing the components and it would also be an option after having used the item of furniture shown in FIG. 2 for a period to change it to the item shown in FIG. 3 by substituting the drawers and pencil trays shown in FIG. 3 for those shown in FIG. 2. This disassembly does not result in any disfigurement of the furniture or any of its components. Not only that but the panels could be reversed so as to change the outer surfaces to the inner surfaces being visible give a change in aesthetic appearance.

Figure 4:
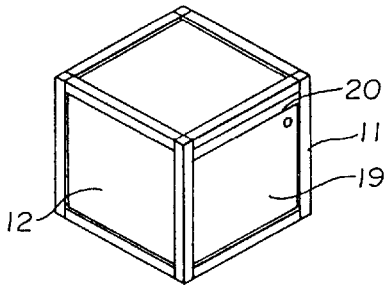
FIG. 4 is a similar view of a unit with a cupboard door and pencil tray.

Likewise FIG. 4 shows another possibility in which there is a cupboard door 19 with a pencil tray 20 above.

Figure 5:
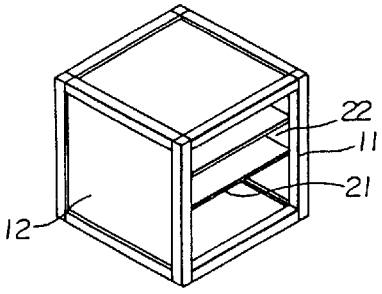
FIG. 5 is a similar view of a unit with three shelves.
Figure 6:
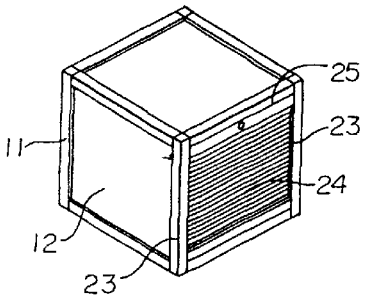
FIG. 6 is a similar unit with a roller door and pencil tray.

FIG. 5 shows yet another possibility, this time showing two shelves 21 and 22. Again the options of FIGS. 4 and 5 would be available either when first purchasing and/or as modifications of the original purchase, for example, as shown in FIG. 2. FIG. 6 shows another option in which the frame components and panels are once again the same as shown in FIGS. 2 to 5 with the exception of the frame components which forms the uprights at the front of the unit of furniture. These have grooves 23 which accommodate the edges of a sliding door 24 with again a pencil tray 25. The sliding door 24 slides downwards and along the base of the unit in order to open the front of the unit. Details of these components are also described below.

Figure 7:
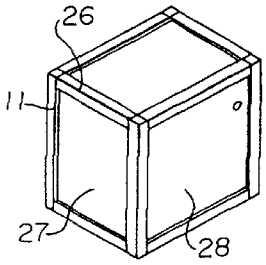
FIG. 7 is a similar unit with less depth.

FIG. 7 shows a unit made up of frame components 11 and shorter frame components 26 with appropriate rectangular panels 27 to make a unit of somewhat lesser depth, for example, 450 mm than those shown in the preceding figures. There is a front door 28 similar to the door 19 shown in FIG. 4 although without space for a pencil tray.

Figure 8:
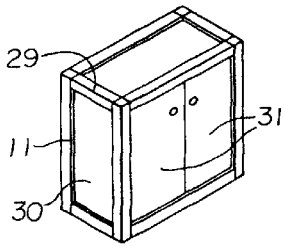
FIG. 8 is a similar view of a two door unit with smaller depth.

FIG. 8 shows a unit which is even narrower using frame components 11 and 29 with narrower rectangular panels 30 and by way of example to front doors 31.

Figure 9:
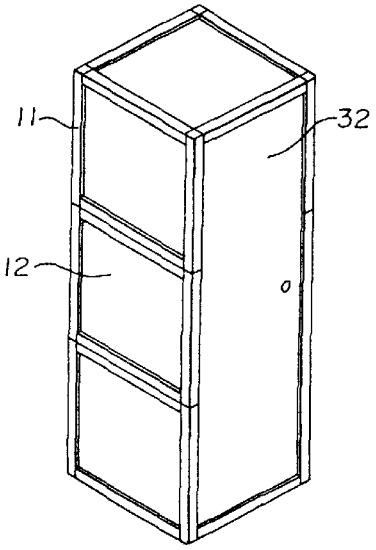
FIG. 9 is a similar view of a high cupboard.
Figure 10:
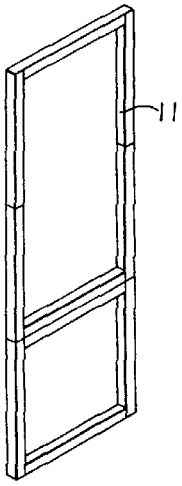
FIGS. 10 and 11 are a similar view of alternative panels.
Figure 11:
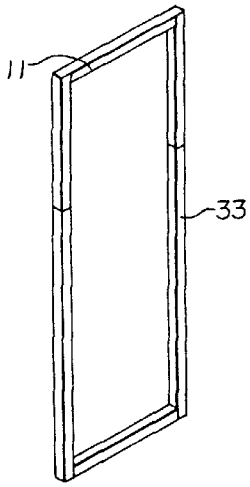

FIG. 9 shows a tall unit again made of frame components 11 and panels 12 but stacked in three units one above the other. A tall door 32 is fitted to the unit. Alternatives for the front frame are shown in FIGS. 10 and 11. In FIG. 11 elongated frame components 33 are shown and in principle frame components the full height of the unit could also be used. The frame components shown in FIG. 10 would allow of course for two front doors.

Figure 12:
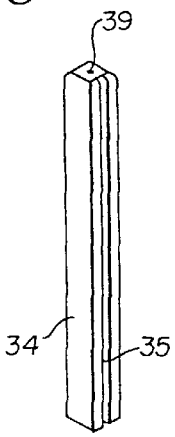
FIGS. 12 to 14 are isometric views of alternative frame components.

FIG. 12 shows a frame component 34 which has a groove 35 on only one of its surfaces, the cross section of the frame component being square. This frame component would be suitable for the front, top horizontal component in a typical unit, for example, the component marked 34 in FIG. 1 since it has to have only one groove to accommodate the top panel of the unit.

Figure 13:
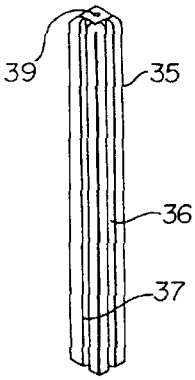

FIG. 13 shows a frame component 35 which has grooves 36 and 37 on two of its surfaces. These frame components would be suitable for the top and bottom, side and back horizontal components of a typical unit, for example the components marked 38 in FIG. 1. The two grooves in each of these components allow for the two adjacent panels edges to be fitted in them. The components shown in FIGS. 12 and 13 also show the holes 39 for receiving the fixing means in the form of a bolt as will be described below.

Figure 14:
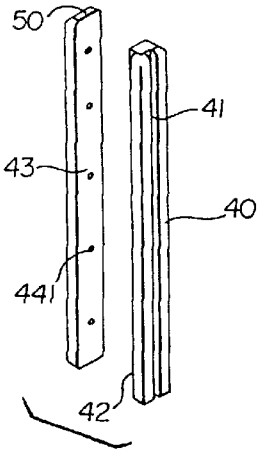

FIG. 14 shows a modified form of frame component which is split longitudinally. This type of frame component is used in a case where four frame components are joined together at their ends in the factory and sold in that way with a panel inserted. The split construction allows the front half of the frame components to be taken off so as to allow removal of the panel. Thus the part 40 of the frame component which carries a groove 41 and a groove 42 would have the part 43 removable by undoing screws that would screw into the holes indicated, for example, at 441.

Figure 15:
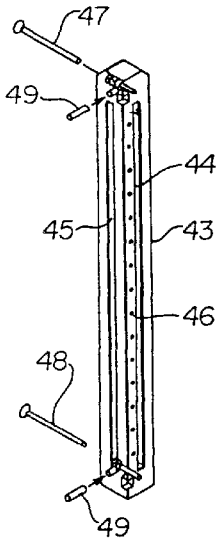
FIGS. 15 to 17 are isometric views of further frame components showing fixing means.
Figure 16:
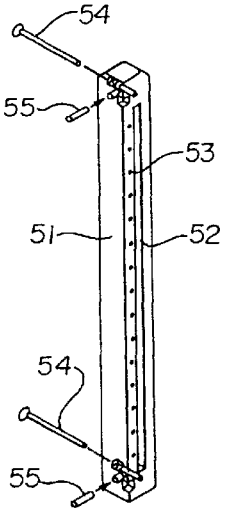
Figure 17:
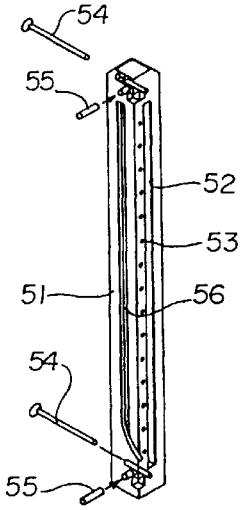

FIGS. 15 to 17 show frame components which are used upright for example in a unit of the kind shown in FIGS. 1 to 11. These are somewhat longer than the frame components shown with reference to FIGS. 12 to 14 in order to obtain a cube proportion of 600 mm outer dimension on all sides. Since the frame components are 44 mm square the frame component shown in FIGS. 15 to 17 are 600 mm in length and those in FIGS. 12 to 14, 512 mm.

The frame components shown in FIG. 15 can be used for the two rear upright frame components. The component 43 (indicated also in FIG. 1) thus have grooves 44 and 45 on two of its surfaces to provide for panels on two sides of the unit. It also has the formations in the form of holes 46 of standardised pitch, for example, a pitch of 34 mm. It also shows bolts 47 and 48 which are used for joining to the ends of contiguous horizontal frame components. The bolts entering the holes 39 and screwing into cross bars in a manner which will be described below with reference to FIGS. 33 and 33A. The view also shows dowels 49 which are used for manufacturing a pre-manufactured frame of 4 frame components. For this purpose the upper dowel 49 is off set from centre so as to be able to enter the hole 50 in a split frame component such as is shown in FIG. 14 which will be placed at the top rear horizontal edge of the unit. This will allow removal of the split part of this frame component if it is desired to remove, turn around or replace the back panel of the unit.

FIG. 16 shows a frame component 51 to form the front upright on both the right hand side and the left hand side of the unit. To achieve this the component is made mirror reversible so that it can be turned around to be used on either side. The groove 52 is in the centre of the front face and the standardised pitch holes 53 begin and end the same distance from the top and bottom ends of the frame component. Again there are bolts 54 for bolting to the top and bottom side horizontal frame components of the unit and dowels 55 for permanent joining by pre-gluing at the factory with the front top and bottom horizontal frame components to form a pre-manufactured four component frame. Since the front surface will not have a panel it is not necessary for any of the frame components used for this part to be split.

FIG. 17 shows a frame component which could be substituted for that shown in FIG. 16 if it is wished to have a sliding front door such as the door 24 shown in FIG. 6. For this purpose a groove 56 is provided in which the door will slide. Other aspects and the same reference numerals are used as in FIG. 16.

Figure 18:
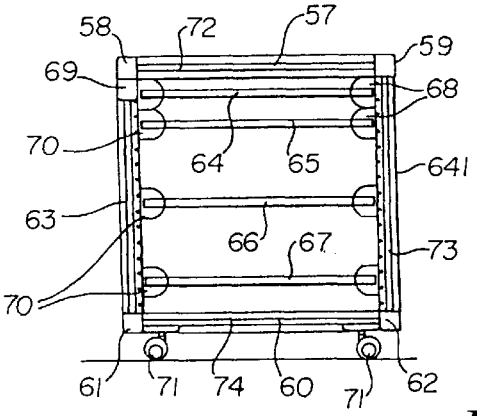

FIG. 18 is a cross sectional side view of the unit sectioned in a vertical section through the middle of the unit. This shows horizontal frame components 57, 58 and 59 at the top and horizontal frame components 60, 61 and 62 at the bottom with two of the vertical frame components 63 and 641. The section view is thus into the interior of the unit and this shows the elongate elements 64, 65, 66 and 67 which in this case are in the form of drawer runners. These are fixed to formations 68 at both ends of each runner. The formations (as can be seen in the views of FIGS. 22 to 25) each have two pins which fit into two of the holes on the frame component which can, for example, be seen designated the holes 46 and 53 in FIGS. 15, 16 and 17. Thus it will be seen that once the frame components are brought together and fixed together at their ends the drawer runners constituting the elongate elements with their end formations are trapped or in other words secured in the selected position shown. This particular selection thus allows for a pencil tray 69 and three drawers 70. The unit is shown as a matter of interest mounted on castors 71. The top panel 72, rear panel 73 and bottom panel 74 can be seen.

Figure 19:
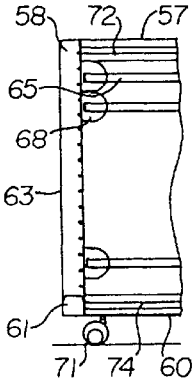
FIG. 19 is a similar partial view showing runner positions for the maximum of seven drawers.

FIG. 19 shows part of a similar view in which the alternative arrangement is adopted of providing runners for up to seven drawers. The same reference numerals are used for the same components as have been used in FIG. 18. This shows that the unit can be changed if desired and again it must be remarked without any defacing of any of the frame components resulting.

Figure 20:
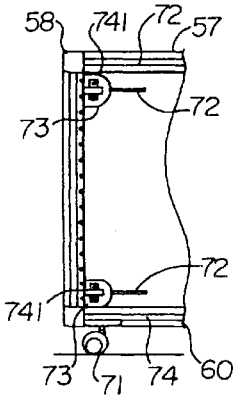
FIG. 20 is a similar partial view showing hinged positions for a glass door.

FIG. 20 is a further partial side sectional view showing elongate components 72 to which end formations 73 are fixed, in this case carrying hinge structure 741.

Figure 21:
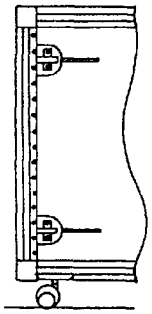
FIG. 21 is a similar partial view for showing a hinged position for a wooden door.

FIG. 21 is a similar view to that of FIG. 20 in which the hinges are shown in a different position.

Figure 22:
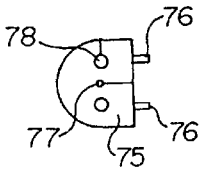
FIGS. 22 and 23 are side and end elevations respectively of formations to be located at the ends of elongate members.
Figure 23:
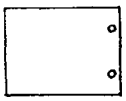
Figure 24:
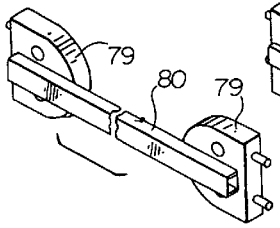
FIG. 24 shows such formations at the ends of a drawer runner.

FIGS. 22 and 23 show side and front elevations respectively of an end component which can be used on the elongate elements. It comprises a body 75 having two pins 76, a fixing screw hole 77 for drawer runners, two fixing holes 78 for attaching hinges and a hole (not seen) on its convex part for receiving an elongate element. FIG. 24 shows, for example, two end formations 79 attached to a drawer runner 80 which is serving as an elongate element.

Figure 25:
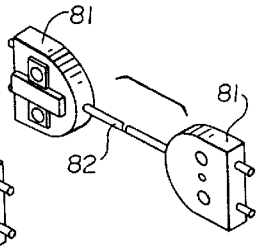
FIG. 25 shows such formations at the ends of an elongate member.

FIG. 25 shows two end formations 81 fixed to an elongate element 82.

Figure 26:
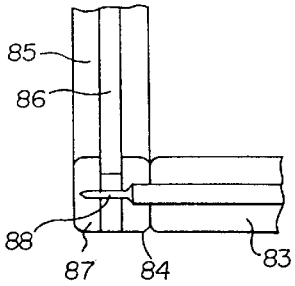
FIG. 26 is a plan view on a corner assembly of the unit.

FIG. 26 is a cross sectional elevation of the bottom cross member of a unit at the back panel of the unit. This shows a horizontal frame component 83, a horizontal frame component 84 attached thereto and upright rear frame component 85 and the rear panel 86. This shows that the frame component 84 is a split component and the outer half of it 87 is screwed onto the inner part of it 84 by means of screws 88 after the rear panel has been inserted. Conversely screws 88 are released and the outer part 87 removed then the rear panel can be slid out in order to be changed. This structure is applicable for the case where four frame components are permanently glued and doweled to each other in the factory.

Figure 27:
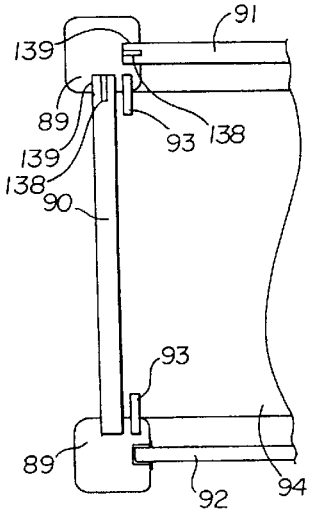
FIG. 27 is a plan view on part of another unit.

FIG. 27 is a cross sectional plan view on a part of a furniture unit. It shows two upright frame components 89, a side panel 90, a rear panel 91 and a front roller shutter 92. It then also shows pins 93 pushed into selected holes of the standardised set of holes in the frame components 89 at the levels required to support a shelf 94. Obviously several shelves can be supported in the unit in this way.

Figure 28:
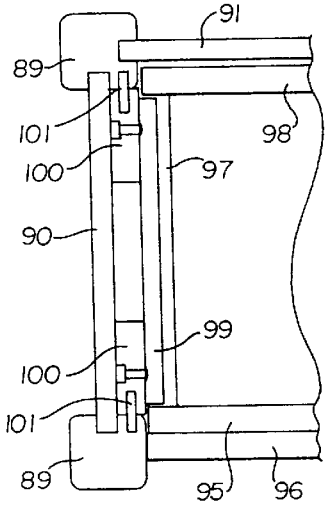
FIGS. 28 and 29 are similar partial views of other units.

FIG. 28 is a similar view of a furniture unit and the same reference numerals are given for the same parts. It differs, however, in that drawers are fitted in the unit and the drawer front 95 and drawer outer face 96 are shown. The sidewall 97 of the drawer and the back wall 98 are also seen. The drawer runner 99 is fixed to the sidewall 97 in the movable part of the runner and the fixed part of the runner is fixed to end formation 100. The fixed part 99 of the drawer runner thus serves as the elongate element to which the two end formations 100 are fitted. These end formations have pins 101 which again fit into selected holes in the standardised series of holes in the frame components 89. In this way the drawers can be fitted at the required level.

Figure 29:
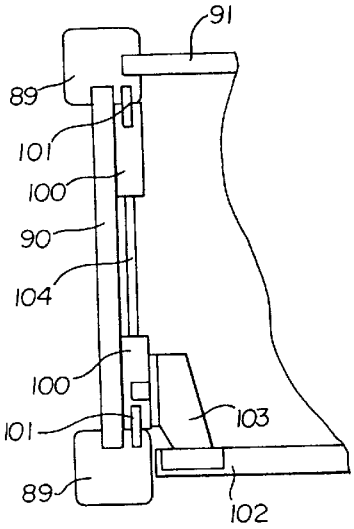

FIG. 29 is a further partial sectional plan view of a similar unit and again the same components of the unit are indicated with the same reference numeral. The differences in this case are that a swinging door 102 is fitted by means of a hinge mechanism 103. The hinge mechanism is fixed to each of the two end formations 100, again held by pins 101 and in this case the elongate formation is in fact a rod 104.

Thus again a given unit of furniture can be adapted to any of the configurations shown in FIGS. 27, 28 or 29. Thus as the requirements for the furniture may change over time it can be modified to suit. Once again there is no defacement of any of the frame components or panels nor is any drilling and screwing or any similar actions necessary.

FIG. 27 shows grooves 138 in the edges of the panels 90 and 91. These grooves give elasticity to the edges of the panels which can be pushed into the grooves 139 with a tight fit. Thus, merely as an example, the grooves 139 could have a width of 5 mm±0.5 mm and the panels thicknesses could be 6.5 mm±1 mm with a 3 mm groove in the panel edges: these dimensions and tolerance ranges will ensure a sung fit in all possible combinations of panels and frame components.

Figure 30:
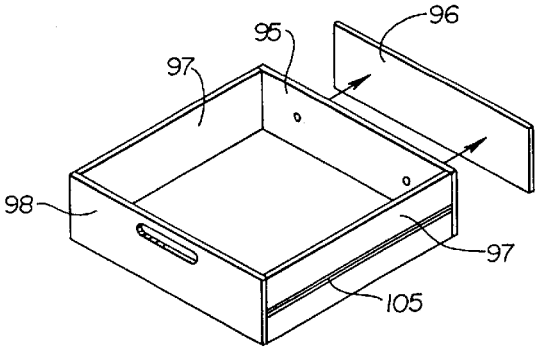
FIG. 30 is an isometric view of a drawer.

FIG. 30 shows a typical drawer and the same reference numerals as was used in the preceding figures for the parts of the drawer are used. A groove 105 is dimensioned to receive the sliding part of the drawer runner.

Figure 31:
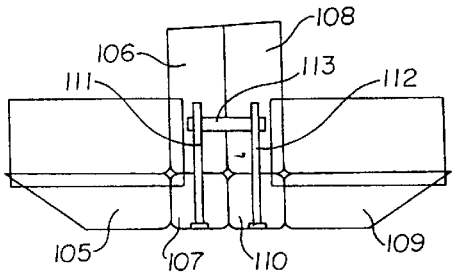
FIG. 31 shows two units fixed together by special fixing means for this purpose.

FIG. 31 shows corners of two adjacent furniture units which are fixed together by the double fixing means of the invention. The view is a plan view and shows the upper horizontal frame components 105 and 106 and an upright frame component 107 at a corner of one unit and the adjacent horizontal frame components 108 and 109 with the upright corner component 110. The double connector of the invention (which can be seen in isometric view in FIG. 37) comprises two bolts 111 and 112 which both screw into a transversely oriented ferrule 1131 which has screw threaded holes for this purpose and which is inserted into holes drilled into the frame components 106 and 108.

Figure 32:
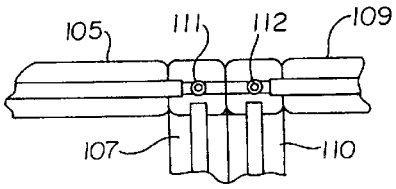
FIG. 32 is an elevation of the view of FIG. 31.

FIG. 32 is a front elevation of this connection of two units and the same reference numerals are used.

Figure 33:
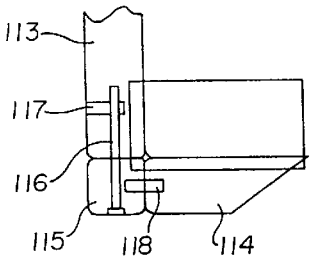
FIG. 33 shows a corner joint.

FIG. 33 shows a fixing means which is conventionally used to assemble a single unit of furniture according to the invention. This means is shown in perspective view in FIG. 33A as well.

Figure 33A:
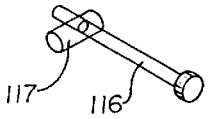
FIG. 33A shows a detail of a bolt and ferrule.

In FIG. 33 which is a plan view two horizontal frame components 113 and 114 are joined at a corner to an upright frame component 115 by means of a bolt 116 which screws into a transversely oriented ferrule 117 which is located in a hole in the component 113. In FIG. 33A the same reference numerals are used.

The view also shows a ferrule 118 which is used for glue jointing the frame components 115 and 114 as part of a pre-manufactured rigid four component frame.

Figure 34:
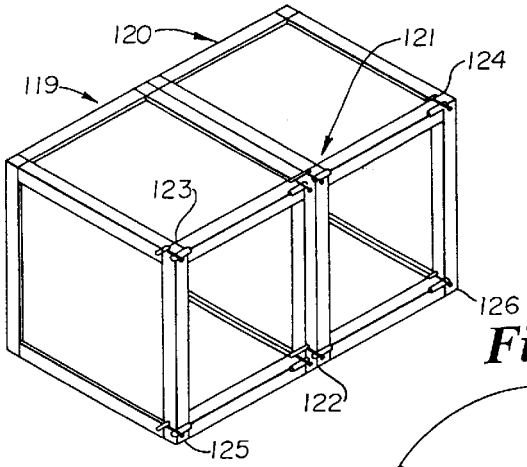
FIG. 34 shows two units fixed together by the fixing means shown in FIGS. 31 and 32, FIGS. 35 and 36 show enlarged views of the adjoining frame components and of a corner of the frame components respectively.
Figure 37:
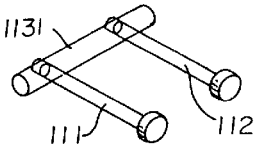
FIG. 37 shows the fixing means for joining together units.

FIG. 34 shows two furniture units 119 and 120 which are joined together by the double connectors of the kind shown in FIG. 37 at their adjacent corners, the front top adjacent corners at 121 and bottom adjacent corners at 122 being visible. The view also shows the routine connectors or standard connectors as shown in FIG. 33A and the front top corners 123 and 124 and front bottom corners 125 and 126.

Figure 35:
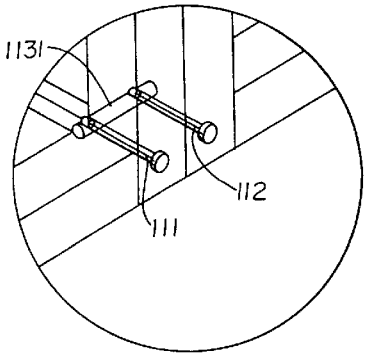
Figure 36:
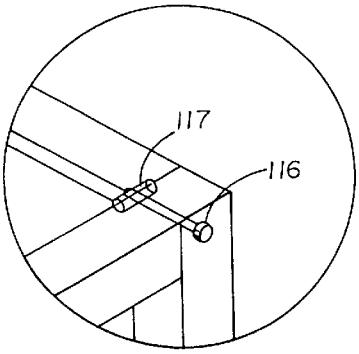

In FIGS. 35 and 36 the double connector and the standard or single connector are shown in enlarged view.

In these figures and in FIG. 37 the same reference numerals are used.

Figure 38:
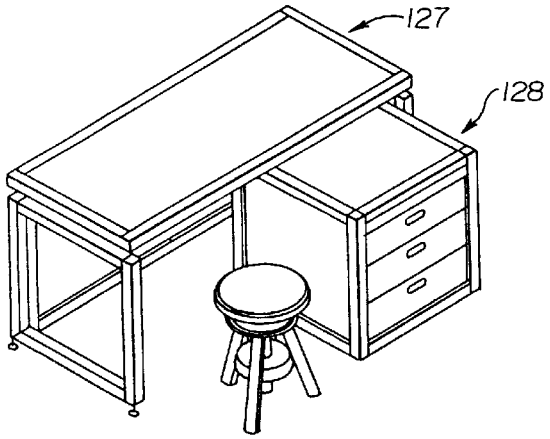
FIG. 38 shows a desk in accordance with the invention.

FIG. 38 shows how the components of the invention can be used to make up an item of furniture in the form of a desk 127 with a set of drawers 128.

As will be appreciated from the preceding description the components used in this desk cum drawers arrangement could be re-used to make quite different kinds of furniture.

Figure 39:
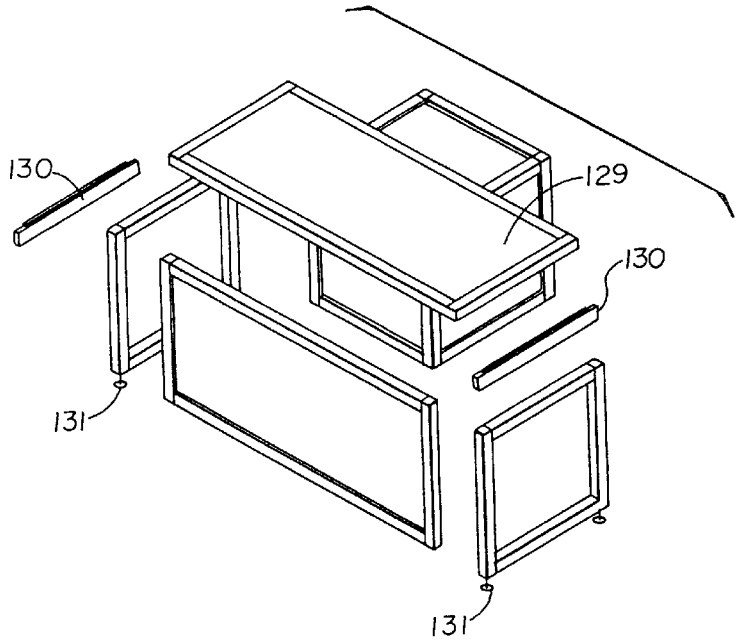
FIG. 39 is an exploded view of the desk.

FIG. 39 shows the same desk in exploded view to more clearly illustrate the way it is put together. What is of interest is that the standard frame components of 600 mm length can be used for the supports for the desk but in order to raise the writing surface 129 to a suitable level, a spacer 130 is used at each end. Adjustable feet 131 are also provided.

Figure 40:
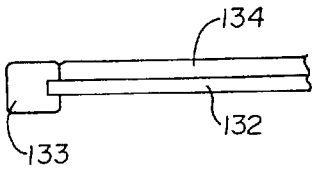
FIG. 40 is a side elevation in section of the desk top.

FIG. 40 furthermore shows that although a typical panel 132 is located in the centre of one side of the frame component 133, in accordance with the principle of the invention, in order to get a flush writing surface for the desk top an extra panel 134 is placed on top of the panel 132. The surround formed by the frame components such as the component 133 neatly holds the insert panel 134 in position. An advantage arises from this in that the panel 134 can have two different surface finishes on its two sides and thus could be turned over to change the surface finish of the desk top.

Figure 41:
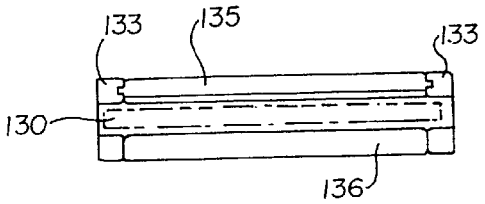
FIG. 41 is a side end elevation of the desk.

FIG. 41 shows as an alternative a specialised panel 135 which has tongues to enter the centrally located grooves in the frame components 133 but is an off set panel to provide the necessary flush tops. The view also shows the spacer 130 which raises the desk top to appropriate level even though it is resting on a frame component 136 of standard 600 mm dimension. The spacer is 56 mm thick and the addition of the desk top increases the extra height above the frame component by 100 mm so that the desk top is 700 mm above floor level not counting the feet 131.

Figure 42:
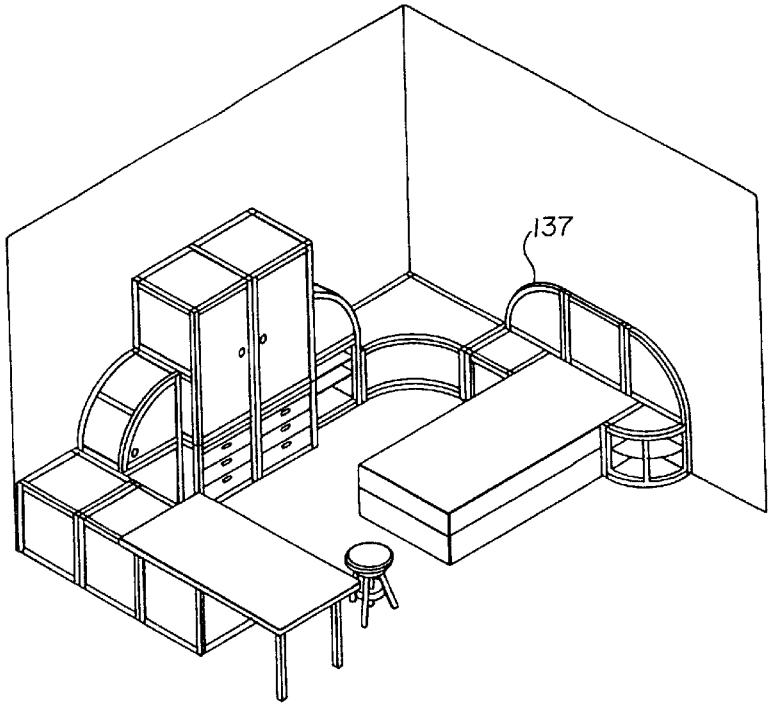
FIG. 42 is an isometric view of a bedroom layout in accordance with the invention.

FIG. 42 shows a bedroom made with components in accordance with the invention. This view is significant in showing that curved components such as component 137 can be employed in accordance with the invention. Other features will be recognisable with relation to descriptions of the preceding figures.

Figure 43:
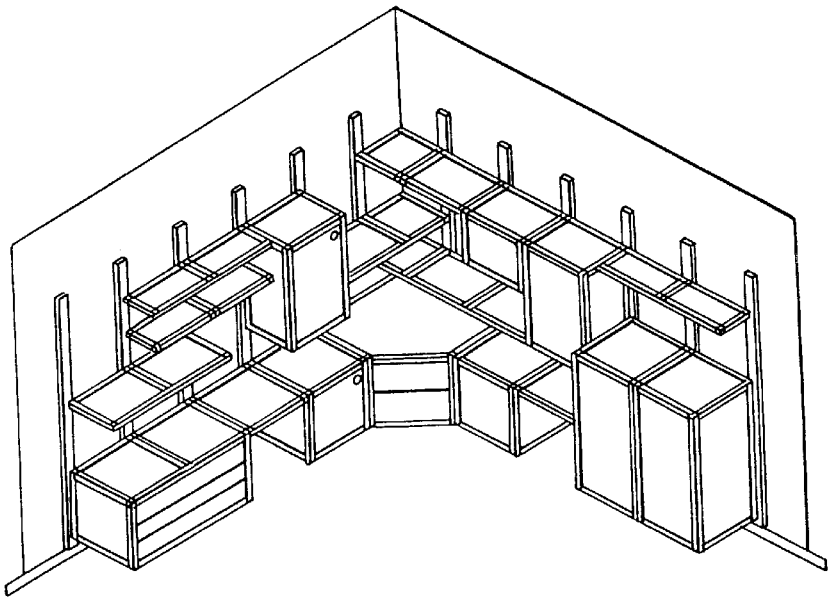
FIG. 43 is an isometric view of a kitchen layout in accordance with the invention.

Likewise FIG. 43 shows an arrangement that could be adopted for a kitchen. Once again it will be noted that many of the furniture units are of the kind described in preceding figures.

We claim:

1. Components for furniture, comprising: a plurality of frame components of elongate form and at least one panel, the frame components having longitudinally extending grooves, the grooves of all the frame components having the same width and position in the frame components, the grooves capable of receiving edges of the panel, the frame components having fixing means near their ends adapted for fixing the frame components to each other, the frame components further comprising formations for receiving the fixing of elements selected from hinges, drawer runners, shelf supports and the edges of the panel have a peripheral groove running all around the panel.

2. Components for furniture as claimed in claim 1, in which the formations for receiving elements selected from hinges, drawer runners, and shelf supports are a plurality of holes provided along the length of the frame components.

3. Components for furniture as claimed in claim 1, provided in combination with elongate elements having end formations at their ends, the elongate elements including their end formations having lengths matching the lengths of the frame components, the formations at the ends of the elongate elements adapted to engage into the formations in the frame components.

4. Components for furniture as claimed in claim 1, in which the fixing means are adapted to unitarily fix together not only said frame components of one unit of furniture but also simultaneously an adjacent unit of furniture.

5. Furniture assembled from components as claimed in claim 1.

* * * * *

UNITED STATES PATENT AND TRADEMARK OFFICE
CERTIFICATE OF CORRECTION

PATENT NO. : 5,921,647

DATED : JULY 13, 1999

INVENTOR(S) : SCHNEIDER ET AL.

It is certified that error appears in the above-identified patent and that said Letters Patent is hereby corrected as shown below:

Front Page, [73] Assignee: "Vavarian" should read --Bavarian--

Col. 10, line 38: insert --and-- after the word "runners,"

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*